US012146293B2

(12) United States Patent
Izumi et al.

(10) Patent No.: US 12,146,293 B2
(45) Date of Patent: Nov. 19, 2024

(54) WORK MACHINE WITH MACHINE CONTROL THAT STORES SNAPSHOT DATA FOR EQUIPMENT ABNORMALITY DIAGNOSIS

(71) Applicant: HITACHI CONSTRUCTION MACHINERY CO., LTD., Tokyo (JP)

(72) Inventors: Shiho Izumi, Hitachinaka (JP); Naoki Hayakawa, Ushiku (JP); Kenta Nakagi, Tsukuba (JP); Yasuhiko Kanari, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 891 days.

(21) Appl. No.: 17/275,368

(22) PCT Filed: Mar. 25, 2020

(86) PCT No.: PCT/JP2020/013468
§ 371 (c)(1),
(2) Date: Mar. 11, 2021

(87) PCT Pub. No.: WO2020/196674
PCT Pub. Date: Oct. 1, 2020

(65) Prior Publication Data

US 2022/0049453 A1 Feb. 17, 2022

(30) Foreign Application Priority Data

Mar. 26, 2019 (JP) ..... 2019-059387

(51) Int. Cl.
*E02F 9/20* (2006.01)
*E02F 3/43* (2006.01)
*E02F 9/26* (2006.01)

(52) U.S. Cl.
CPC ..... *E02F 9/2054* (2013.01); *E02F 3/43* (2013.01); *E02F 9/267* (2013.01); *E02F 9/268* (2013.01)

(58) Field of Classification Search
CPC ..... E02F 9/205; E02F 9/2054; E02F 9/267; E02F 9/268; E02F 9/261; E02F 9/264; E02F 3/43; E02F 9/262
See application file for complete search history.

(56) References Cited

U.S. PATENT DOCUMENTS 6,449,884 B1 * 9/2002 Watanabe ..... E02F 9/267 701/50
7,532,967 B2 * 5/2009 Fujishima ..... E02F 9/265 701/50

(Continued)

FOREIGN PATENT DOCUMENTS

JP 2002-180502 A 6/2002
JP 2013-114580 A 6/2013

(Continued)

OTHER PUBLICATIONS

Korean Office Action received in corresponding Korean Application No. 10-2021-7005534 dated Sep. 22, 2022.

(Continued)

*Primary Examiner* — Adam J Behrens
*Assistant Examiner* — Blake E Scoville
(74) *Attorney, Agent, or Firm* — MATTINGLY & MALUR, PC

(57) ABSTRACT

In a hydraulic excavator including a controller configured to calculate the magnitude of a position difference in a height direction between a construction target surface and a front work implement on the basis of the position of the construction target surface, the position of a machine main body which is calculated by a GNSS receiver, and the posture of the front work implement which is detected by a posture (Continued)

sensor. The controller records snapshot data of information about an operation sensor, a pressure sensor, the posture sensor, the GNSS receiver, and a radio in a predetermined period that is determined based on a time at which the magnitude of the position difference exceeds a predetermined value when the magnitude of the position difference exceeds the predetermined value, and diagnoses a cause of the magnitude of the position difference exceeding the predetermined value, on the basis of the snapshot data.

7 Claims, 9 Drawing Sheets

(56) References Cited

U.S. PATENT DOCUMENTS

| | | | | |
|---|---|---|---|---|
| 7,684,917 | B2 * | 3/2010 | Furuno | E02F 9/26 700/83 |
| 7,869,923 | B2 * | 1/2011 | Kawaguchi | E02F 9/2214 180/326 |
| 7,975,410 | B2 * | 7/2011 | Faivre | G05D 1/0891 37/379 |
| 9,317,978 | B2 * | 4/2016 | Hiruta | H04L 67/10 |
| 9,458,600 | B2 * | 10/2016 | Nelson | E02F 3/845 |
| 9,473,885 | B2 * | 10/2016 | Yamasaki | H04W 4/40 |
| 9,619,146 | B2 * | 4/2017 | Fujimori | G06F 3/0604 |
| 9,868,623 | B1 * | 1/2018 | Guy | B66F 9/12 |
| 10,048,692 | B2 * | 8/2018 | Hamada | G05D 1/0044 |
| 10,066,367 | B1 * | 9/2018 | Wang | E02F 9/262 |
| 10,147,339 | B2 * | 12/2018 | Kozumi | G09B 19/24 |
| 10,876,275 | B2 * | 12/2020 | Yamazaki | E02F 9/20 |
| 2003/0146845 | A1 * | 8/2003 | Imanishi | F04B 51/00 340/679 |
| 2006/0031042 | A1 * | 2/2006 | Ogura | G05B 19/4185 702/184 |
| 2007/0213855 | A1 * | 9/2007 | Furuno | E02F 9/26 700/83 |
| 2013/0302124 | A1 | 11/2013 | Matsuyama | |
| 2014/0231153 | A1 * | 8/2014 | Fukasu | E02F 9/2029 177/25.13 |
| 2015/0112544 | A1 | 4/2015 | Tsukamoto | |
| 2015/0198936 | A1 * | 7/2015 | McGee | H04W 88/00 700/40 |
| 2016/0226977 | A1 * | 8/2016 | Fujiwara | H04L 67/12 |
| 2018/0002900 | A1 | 1/2018 | Morimoto | |
| 2018/0051446 | A1 * | 2/2018 | Yoshinada | E02F 9/264 |

FOREIGN PATENT DOCUMENTS

| | | | |
|---|---|---|---|
| JP | 2016-224038 | A | 12/2016 |
| JP | 2017-108429 | A | 6/2017 |
| JP | 2018-003386 | A | 1/2018 |
| KR | 10-2015-0102445 | A | 9/2015 |

OTHER PUBLICATIONS

Chinese Office Action received in corresponding Chinese Application No. 202080004782.X dated Dec. 31, 2021.

International Preliminary Report on Patentability received in corresponding International Application No. PCT/JP2020/013468 dated Oct. 7, 2021.

International Search Report of PCT/JP2020/013468 dated Jun. 23, 2020.

* cited by examiner

WORK MACHINE WITH MACHINE CONTROL THAT STORES SNAPSHOT DATA FOR EQUIPMENT ABNORMALITY DIAGNOSIS

TECHNICAL FIELD

The present invention relates to a work machine.

BACKGROUND ART

Recently, the introduction of computerized construction has been underway on construction sites. Computerized construction is a system for achieving higher efficiency of construction by an information communication technology (ICT: Information and Communication Technology) with attention directed to construction among processes such as survey, design, construction, inspection, and management, and with utilization of electronic information. Known as a work machine supporting computerized construction is a hydraulic excavator that incorporates a guidance function of displaying, on a monitor, information on a machine body position, the posture of a front work implement, and the position of a construction target surface, and a machine control function of preventing a bucket located at a distal end of the front work implement from entering below the construction target surface. The work machine supporting such computerized construction provides functions of presenting information to an operator, assisting in work, and assisting in operation on the basis of computerized construction data having three-dimensional coordinate information.

The work machine is often operated continuously on a construction site or the like so that construction is completed before a construction period desired by a construction client ends. Thus, when an abnormality such as a failure has occurred in the work machine, repair or the like needs to be performed quickly. The work machine supporting computerized construction needs to include a satellite positioning system, a posture sensor, a communication terminal, a radio, a pressure sensor, hydraulic equipment including a solenoid valve, and the like in a machine body in order to calculate the position of the machine body, the posture of the front work implement, and the like. When such equipment fails, functions of the computerized construction machine are lost, and the construction period is also affected. Therefore, when an abnormality has occurred in the machine on the site, it is necessary to grasp the state of each piece of equipment, immediately determine whether the cause of the abnormality is a failure in the equipment, and then determine a subsequent measure.

A hydraulic excavator operation management system is known as a conventional system that manages whether or not an abnormality has occurred in the work machine. A controller of a hydraulic excavator in a typical operation management system records and collects operation data related to the operation state of mounted equipment such as a start and a stop of an engine and pump oil pressure, integrates the operation data into data in units of one day, and transmits the operation data of a previous day to a computer of a ground station through satellite communication at a time of a start of operation on a next day, for example. The computer of the ground station transmits the received operation data to a computer (server) of a management section remote from the work site via an Internet line, for example.

In relation to this kind of operation management system, a system described in Patent Document 1 displays a plurality of pieces of work position information and a work state of a hydraulic excavator on a work site, on a monitor (display device) within a cabin of the hydraulic excavator in order to perform more detailed operation management of the hydraulic excavator on the work site. More detailed operation management than conventional is thereby made possible.

PRIOR ART DOCUMENT

Patent Document

Patent Document 1: JP-2013-114580-A

SUMMARY OF THE INVENTION

Problems to be Solved by the Invention

Unlike a conventional hydraulic excavator, the hydraulic excavator supporting computerized construction may include an RTK (Real Time Kinematic)-GNSS receiver that receives signals transmitted from a plurality of positioning satellites by two antennas for GNSS (Global Navigation Satellite System) and calculates the position and azimuth angle of the hydraulic excavator (upper swing structure) in a geographic coordinate system; and a radio for receiving correction information used by the RTK-GNSS receiver to realize high-accuracy positioning calculation from a reference station (reference point). When an abnormality occurs in the work machine supporting such computerized construction (the work machine may be referred to as a "computerized construction machine"), not only a failure in the mounted equipment as mentioned above but also a surrounding environment affecting states of communication with positioning satellites and the reference station (for example, an obstacle obstructing the direct arrival of radio waves and the presence of radio interference) may be the cause of the abnormality. That is, it is important to identify the cause of the abnormality while considering information about the surrounding environment or the like, to which attention has not been directed in the conventional operation management system. In particular, the computerized construction machine may automatically operate a part of actuators by using a machine control function, and therefore, it is more important than ever to record the occurrence of an abnormality phenomenon and investigate the abnormality phenomenon.

However, the technology described in Patent Document 1 performs detailed operation management of the conventional hydraulic excavator but does not assume the computerized construction machine that constructs a construction target surface. Therefore, a case where the bucket enters under the construction target surface, for example, cannot be detected as an abnormality, and the cause of the abnormality occurring in the computerized construction machine cannot be identified correctly because information about the hydraulic excavator which is recorded at a time of occurrence of the abnormality does not include information indicating the states of communication with positioning satellites and the reference station.

The present invention has been made to solve the above-described problems. It is an object of the present invention to provide a work machine that, when a problem occurs in operation as a computerized construction machine, can identify the cause of the problem including not only a failure in equipment but also surrounding conditions related to construction and the like such as states of communication with positioning satellites and a reference station.

Means for Solving the Problems

The present application includes a plurality of types of means for solving the above-described problems. To cite an example of the means, there is provided a work machine including a work implement attached to a machine main body; an operation sensor that detects an operation of the work implement by an operator; a pressure sensor that detects a pressure on a hydraulic actuator that drives the work implement; a posture sensor that detects a posture of the work implement; an antenna that is attached to the machine main body and receives satellite signals from a plurality of positioning satellites; a receiver configured to calculate a position of the machine main body on a basis of the satellite signals received by the antenna; a first communication device that receives, from a base station, a correction signal used when the receiver calculates the position of the machine main body; and a controller having a storage device storing a position of a construction target surface, and configured to calculate magnitude of a position difference in a height direction between the construction target surface and the work implement on a basis of the position of the construction target surface stored in the storage device, the position of the machine main body calculated by the receiver, and the posture of the work implement detected by the posture sensor. The controller is configured to record, in the storage device, snapshot data of information about the operation sensor, the pressure sensor, the posture sensor, the receiver, and the first communication device in a predetermined period determined based on a time at which the magnitude of the position difference exceeds a predetermined value when the magnitude of the position difference exceeds the predetermined value, and diagnose a cause of the magnitude of the position difference exceeding the predetermined value, on a basis of the snapshot data.

Advantage of the Invention

According to the present invention, it is possible to obtain the snapshot data of information about equipment necessary for computerized construction (for example, the receiver configured to calculate the position of the machine main body and the first communication device that receives the correction signal from the base station) at a time of occurrence of an abnormality. It therefore becomes easy to identify not only a failure in equipment but also an abnormality cause related to states of communication with positioning satellites and a reference station by referring to the snapshot data.

MODES FOR CARRYING OUT THE INVENTION

Figure 1:
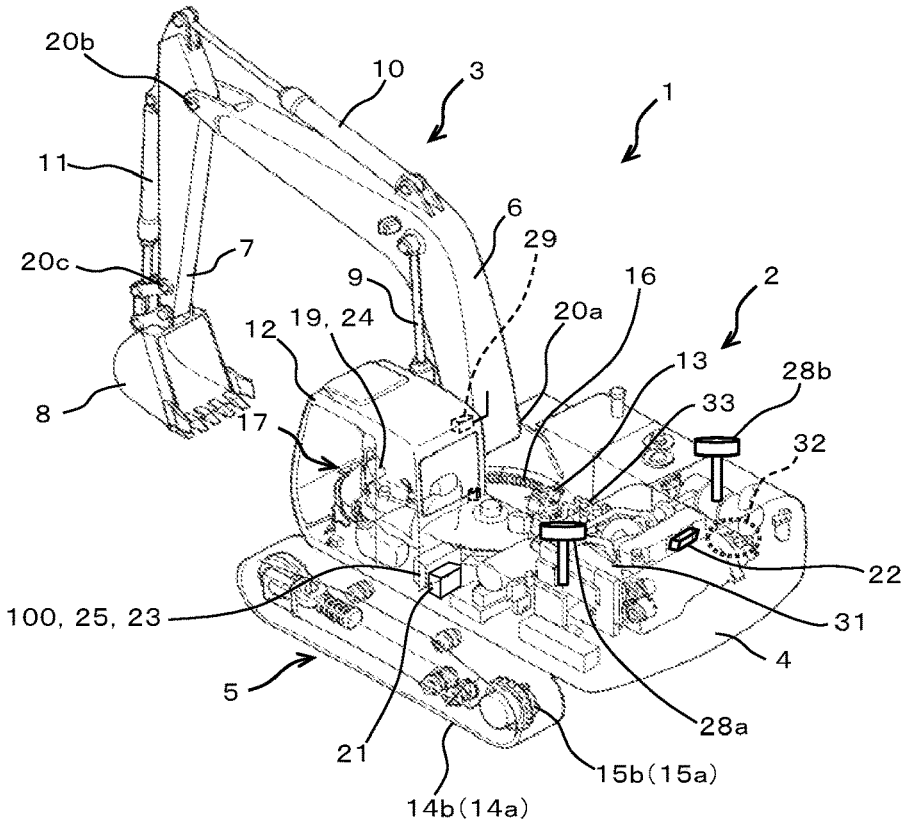
FIG. 1 is a schematic diagram showing an example of a configuration of an excavator according to an embodiment of the present invention.

A work machine management system according to an embodiment of the present invention will hereinafter be described. The present embodiment is an application of the present invention to a hydraulic excavator of a crawler type as a work machine and determines whether or not an abnormality has occurred on the basis of a distance (target surface distance) between a front work implement of the hydraulic excavator and a construction target surface. Incidentally, in each figure, the same members are identified by the same reference numerals, and repeated description thereof will be omitted as appropriate. In addition, in the following description, when there are a plurality of similar members, the plurality of similar members may be denoted with lowercase alphabetic letters added to ends of reference numerals. However, the plurality of members may be denoted collectively with the lowercase alphabetic letters omitted. For example, when there are three similar valves 10*a*, 10*a*, and 10*a*, these valves may be denoted collectively as valves 10.

FIG. 1 is a schematic diagram of a hydraulic excavator 1 according to an embodiment of the present invention. In FIG. 1, the hydraulic excavator 1 includes a machine main body 2 and a front work implement 3 as an articulated work implement. The machine main body 2 includes a lower track structure 5 configured to be able to travel by crawlers driven by travelling motors 15*a* and 15*b* and an upper swing structure 4 that is swingably provided to the lower track structure 5 and to which the front work implement 3 is attached.

The front work implement 3 includes a plurality of front implement members such as a boom 6, an arm 7, and a bucket (attachment) 8. The front implement members 6, 7, and 8 are respectively driven by a boom cylinder 9, an arm cylinder 10, and a bucket cylinder 11.

The front work implement 3 is equipped with a plurality of posture sensors 20 (20*a*, 20*b*, and 20*c*) for detecting the posture of the front work implement 3. The posture sensor 20*a* is a boom angle sensor for detecting the posture (rotational angle) of the boom 6. The posture sensor 20*b* is an arm angle sensor for detecting the posture (rotational angle) of the arm 7. The posture sensor 20*c* is a bucket angle sensor for detecting the posture (rotational angle) of the bucket 8. Incidentally, the posture sensors 20 in the present embodiment are potentiometers that detect the rotational angles of the respective front implement members 6, 7, and 8. However, inertial measurement units that detect the inclination angles of the respective front implement members 6, 7, and 8 may be used as the posture sensors 20. The upper swing structure 4 is provided with inclination angle sensors (for example, inertial measurement units) 26*a* and 26*b* that detect inclination angles (a pitch angle and a roll angle) of the upper swing structure 4, as posture sensors.

The upper swing structure 4 is provided with devices including, for example, a cab 12 boarded by an operator; a swing hydraulic motor 13 for swinging the upper swing structure 4 left and right; an engine 31; a hydraulic pump 32 that is driven by the engine 31 and supplies a hydraulic operating fluid to each of the hydraulic actuators 9, 10, 11, 13, and 15; and a control valve 33 that controls the hydraulic operating fluid supplied from the hydraulic pump 32 to each of the actuators 9, 10, 11, 13, and 15.

The upper swing structure 4 is further equipped with two GNSS antennas 28*a* and 28*b* for receiving satellite signals from a plurality of positioning satellites; a GNSS receiver 21 (see FIG. 4) for calculating the position and azimuth angle of the machine main body 2 (upper swing structure 4) in a geographic coordinate system (global coordinate system) on the basis of a plurality of satellite signals received by the two GNSS antennas 28*a* and 28*b*; a camera (surrounding information sensor) 22 for sensing surrounding information on the machine main body 2 by photographing surroundings of the machine main body 2 (upper swing structure 4); a radio (first communication device) 29 for receiving, from a reference station, a correction signal used when the GNSS receiver 21 calculates the position of the machine main body 2 (upper swing structure 4); and a communication device (second communication device) 23 for two-way communication with external terminals including an external management server 102 (see FIGS. 2 and 4) (for example, controllers of other hydraulic excavators and other computers).

The cab 12 houses a control lever (operation device) 17 for the operator to operate the front work implement 3, the upper swing structure 4, the lower track structure 5, and the like. The operator can drive each of the boom cylinder 9, the arm cylinder 10, the bucket cylinder 11, the swing hydraulic motor 13, and the travelling motors 15*a* and 15*b* by operating the control lever 17. The control lever 17 in the present embodiment is of a hydraulic pilot type. Detection of an operation input to the control lever 17 by the operator is performed by an operation sensor 34 (see FIG. 4) as a pressure sensor by detecting a pilot pressure generated by the operation of the control lever 17.

In addition, a touch panel display 19 incorporating various kinds of setting functions and display functions for construction is installed in the cab 12. The touch panel display 19 in the present embodiment functions as a display device (monitor) that displays various kinds of information about the hydraulic excavator 1 and construction on a screen, and also functions as a construction target surface setting device 24 for setting a construction target surface.

In addition, the cab 12 is provided with a controller 100 having a storage device 25 that stores the position of the construction target surface. The controller 100 calculates a target surface distance as a distance between the construction target surface and the front work implement 3 on the basis of the position of the construction target surface which is stored in the storage device 25, the position of the machine main body 2 which is calculated by the GNSS receiver 21, and the posture of the front work implement 3 which is detected by the posture sensors 20. Incidentally, though the controller 100 and the storage device 25 are installed within the cab 12 in the present embodiment, the controller 100 and the storage device 25 may be installed outside the cab. In addition, the storage device 25 does not need to be provided within the controller 100 and may be an external storage device (for example, a semiconductor memory) independent of the controller 100, for example.

The lower track structure 5 has crawlers 14*a* and 14*b* on both a left side and a right side. The hydraulic excavator 1 travels when the left and right crawlers 14*a* and 14*b* are respectively driven by the left and right travelling motors 15*a* and 15*b*. The upper swing structure 4 is rotatably connected to the lower track structure 5 via a swing wheel 16 and is driven by the swing hydraulic motor 13.

Figure 2:
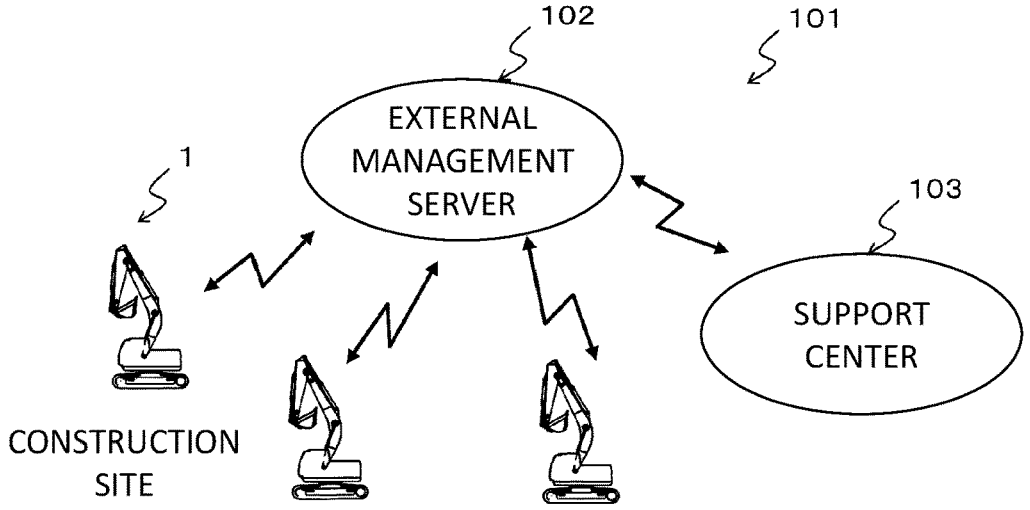
FIG. 2 is a schematic diagram showing an example of a configuration of a management system according to the embodiment of the present invention.

FIG. 2 is a diagram schematically showing an example of a configuration of a management system 101 related to the embodiment of the present invention. The management system 101 manages, for example, plans and progress conditions of construction by a plurality of work machines, visualizes these conditions, and provides the visualized conditions to a user.

In the example of FIG. 2, the hydraulic excavator 1 is operating as a work machine on a certain construction site. Work machines on the construction site are each an ICT work machine (computerized construction machine) capable of performing computerized construction. Incidentally, while the work machines are hydraulic excavators 1 in the present embodiment, the present embodiment may also be targeted to bulldozers or dump trucks.

The hydraulic excavator 1 performs work such as soil excavation, cutting, embankment, or ground leveling on the construction site. The external management server 102 is, for example, a computer including a calculation processing device (for example, a CPU), a storage device (for example, a ROM or a RAM), and the like. The external management server 102 is connected to another terminal such as a computer installed in a support center 103 via a communication network such as the Internet and is capable of mutual communication with the support center 103. For example, a design terrain profile of the construction site is created on the terminal in the support center 103, and the design terrain profile is transmitted as construction target surface data (design surface data) to the hydraulic excavator 1 via the external management server 102. The external management server 102 and the terminal in the support center 103 may be respectively constituted by a plurality of servers and a plurality of terminals.

The external management server 102 receives information transmitted from the hydraulic excavators 1 and, for example, transmits and receives information to and from each hydraulic excavator 1 through satellite communication and mobile telephone communication. The external management server 102 stores information (for example, snapshot data to be described later) transmitted from the hydraulic excavator 1 through the communication network and manages the information such that an administrator or a user can refer to the information as required.

Figure 4:
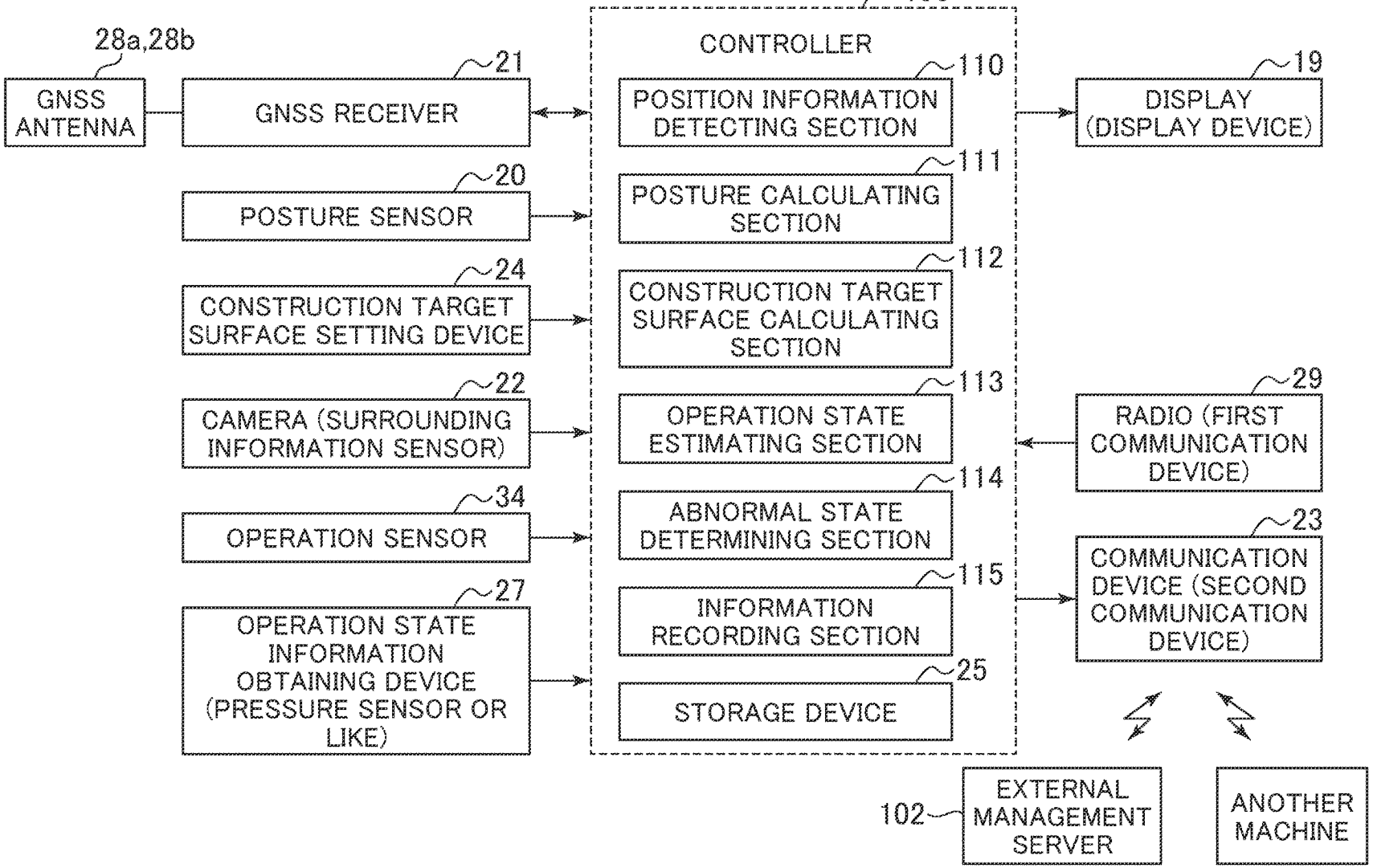
FIG. 4 is a diagram illustrating a functional block diagram of a controller 100 according to the embodiment of the present invention.

FIG. 4 represents a functional block diagram of the controller 100 incorporated in the hydraulic excavator 1 according to the present embodiment. The controller 100 includes a calculation processing device (for example, a CPU), a storage device (for example, a semiconductor memory such as a ROM or a RAM) 25, and an interface (input-output device). The controller 100 executes a program (software) stored in the storage device 25 in advance by the calculation processing device, performs calculation processing by the calculation processing device on the basis of data defined in the program and data input from the interface, and outputs a signal (calculation result) from the interface to the outside. Incidentally, though not shown, the GNSS receiver 21 can also have the same kind of hardware as the controller 100. The controller 100 is connected to the GNSS receiver 21, the posture sensors 20, the construction target surface setting device 24 (display 19), the camera (surrounding information sensor) 22, the operation sensor 34, an operation state information obtaining device 27, the display 19, the radio (first communication device) 29, and the communication device (second communication device) 23 via interfaces. Then, the controller 100 functions as a position information detecting section 110, a posture calculating section 111, a construction target surface calculating section 112, an operation state estimating section 113, an abnormal state determining section 114, and an information recording section 115 by executing the program stored in the storage device 25.

The GNSS receiver 21 is a device for calculating the position and azimuth angle of the machine main body 2 (upper swing structure 4) in the geographic coordinate system. In the present embodiment, the GNSS receiver 21 is connected to the two GNSS antennas 28*a* and 28*b*. The GNSS antennas 28*a* and 28*b* are antennas for RTK-GNSS (Real Time Kinematic-Global Navigation Satellite Systems). The GNSS receiver 21 can measure position coordinate values of the respective antennas 28*a* and 28*b*, the coordinate values including the latitudes, longitudes, and ellipsoidal heights of the respective antennas 28*a* and 28*b*. In addition, the azimuth angle of the upper swing structure 4 can be calculated by calculating a vector from one GNSS antenna 28*a* to the other GNSS antenna 28*b* on the basis of the measured coordinate values of the respective GNSS antennas 28*a* and 28*b*. The GNSS receiver 21 outputs information about the position and azimuth angle (orientation) of the hydraulic excavator 1, the position and azimuth angle being computed as described above, to the controller 100.

Figure 3:
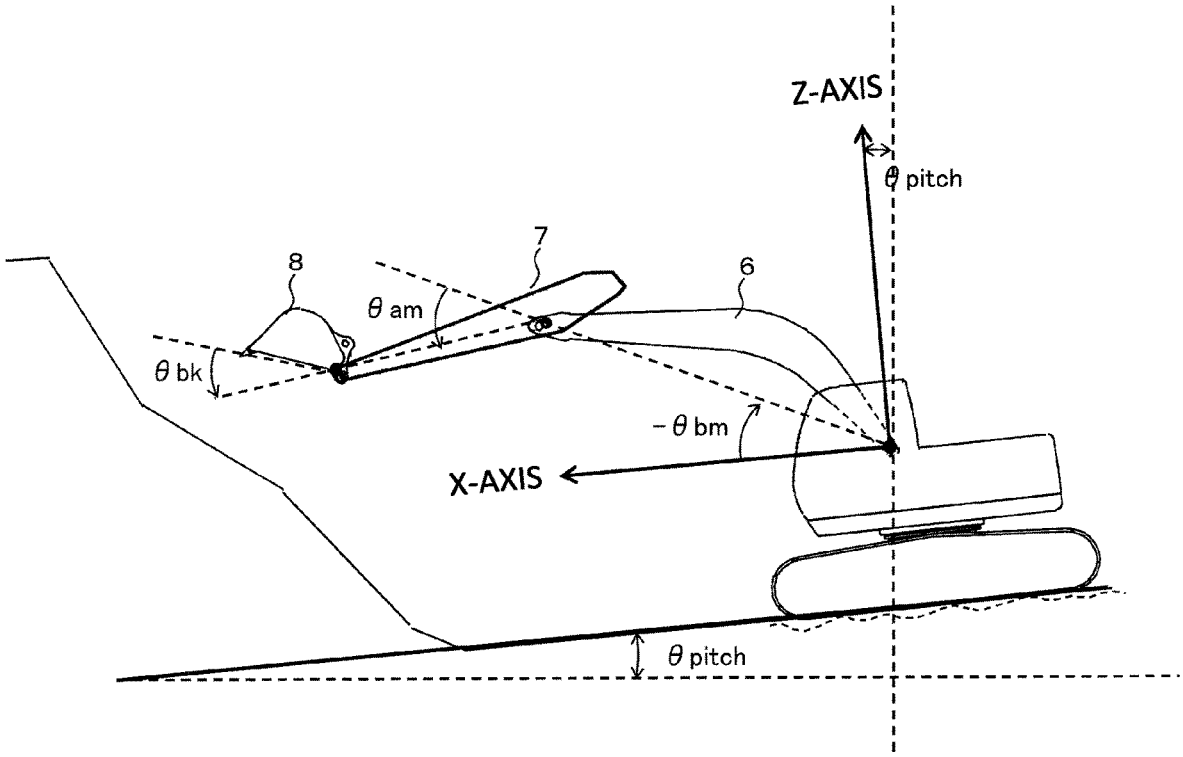
FIG. 3 is a diagram illustrating a machine body coordinate system set to the hydraulic excavator of FIG. 1.

The posture sensors 20 are devices for obtaining the posture information on the front work implement 3. The posture sensors 20, for example, measure rotation by the angle sensors attached to the boom 6, the arm 7, and the bucket 8. Here, FIG. 3 shows an outline of a coordinate system (machine body coordinate system) of the hydraulic excavator 1. An X-axis and a Z-axis represent a machine body coordinate system in which a boom pin is set as an origin, an upward direction of a machine body is set as the Z-axis, a forward direction of the machine body is set as the X-axis, and a left direction of the machine body is set as a Y-axis.

Inclination angle sensors 26*a* and 26*b* that detect a roll angle θroll and a pitch angle θpitch are attached to the upper swing structure 4. The posture sensor 20*a* detects an angle θbm of the boom 6 by measuring a rotational angle of the boom pin that couples the upper swing structure 4 and the boom 6 to each other. The posture sensor 20*b* detects an angle θam of the arm 7 by measuring a rotational angle of an arm pin that couples the boom 6 and the arm 7 to each other. The posture sensor 20*c* detects an angle θbk of the bucket 8 by measuring a rotational angle of a bucket pin that couples the arm 7 and the bucket 8 to each other. The angle information on the parts 4, 6, 7, and 8 which is computed as described above is output to the controller 100.

The construction target surface setting device 24 is, for example, a controller sharing the display 19 prepared for computerized construction. The construction target surface setting device 24 allows settings of work contents and various kinds of settings to be made in addition to a setting of the construction target surface and allows settings related to machine guidance to be made. For example, three-dimensional construction target surface data can be input to the construction target surface setting device 24 via a USB memory or the like. In addition, the construction target surface can also be read by input from the server via the network. This device may also serve as a controller or may be a terminal such as a tablet.

The camera (surrounding information sensor) 22 is a device for obtaining information about surrounding conditions of the machine main body 2 and is, for example, a device for detecting an object that is an obstacle to satellite signals transmitted from positioning satellites. While only one camera 22 is installed in the rear of the upper swing structure 4 in FIG. 1, a plurality of cameras 22 may be installed along the perimeter of the upper swing structure 4 in order to thoroughly grasp the surrounding conditions of the upper swing structure 4. In addition, the surrounding information sensor 22 is not limited to a camera and may be a sensor such as a laser radar.

The operation sensor 34 is a sensor for detecting an operation of the operator. In the present embodiment, the operation sensor 34 is a pressure sensor that detects a pilot pressure output according to an operation of the control lever 17 by the operator.

The operation state information obtaining device 27 is a device for obtaining information about the operation state of the hydraulic excavator (machine body) 1 (operation state information). The operation state information includes information about the operation state of each piece of equipment included in the hydraulic excavator 1, such as the engine 31, a hydraulic system, the posture sensors 20, the GNSS receiver 21, the construction target surface setting device 24, the camera 22, the radio 29, and the communication device 23. In the present embodiment, pressure sensors respectively attached to bottom side hydraulic chambers and rod side hydraulic chambers of the hydraulic cylinders 9, 10, and 11 that operate the front work implement 3 are used as the operation state information obtaining device 27, and the output of the pressure sensors is output to the controller 100.

The display 19 is a device for displaying a result of diagnosis of the cause of an abnormality by the controller 100 and various kinds of information. In the present embodiment, the display 19 is a monitor of a liquid crystal display installed in the cab 12, and the screen of the monitor displays information such as an image of the hydraulic excavator 1 as viewed from the side, the image being generated on the basis of information obtained by each posture sensor 20, and the sectional shape of the construction target surface.

The storage device 25 is a device for recording various kinds of information, the device being possessed by the controller 100. The storage device 25 can also be made independent of the controller 100 and can be configured, for example, as a nonvolatile storage medium such as a flash memory to be detachable through a dedicated insertion port within the cab 12.

The radio (first communication device) 29 is a communication device for receiving, from the reference station, a correction signal used when the GNSS receiver 21 calculates the position of the machine main body 2 (upper swing structure 4). Positioning accuracy is improved when the correction signal received by the radio 29 is used for positioning calculation in the GNSS receiver 21.

The communication device (second communication device) 23 is a device for mutual communication between the hydraulic excavator 1 and an external terminal. The communication device 23, for example, transmits and receives information between the hydraulic excavator 1 and the server 102 at a remote place through satellite communication. Specifically, the communication device transmits information recorded in the storage device 25 or secondary information generated on the basis of the information recorded in the storage device 25, to the server 102. In addition, the communication device 23 may realize exchange of information between the hydraulic excavator 1 and a base station through a mobile telephone network and a narrow band wireless communication network.

Next, each of functions of the controller 100 will be described. The position information detecting section 110 can transform any coordinate value in the machine body coordinate system shown in FIG. 3 into a coordinate value in the geographic coordinate system, on the basis of the latitude, longitude, and height information (coordinate values in the geographic coordinate system) of the GNSS antenna 28*a* and the GNSS antenna 28*b*, the latitude, longitude, and height information being calculated by the GNSS receiver 21. When the coordinate value of the GNSS antenna 28*a* in the machine body coordinate system is known on the basis of design dimensions and measurement by measurement equipment such as a total station, the machine body coordinate system and the geographic coordinate system can mutually be transformed by using a coordinate transformation parameter obtained on the basis of the pitch angle θpitch and the roll angle θroll of the machine body, the position coordinates of the GNSS antenna 28*a* in the machine body coordinate system, and the geographic coordinate system. The position coordinates of the boom pin in the geographic coordinate system, the boom pin being set as the origin of the machine body coordinate system, can be computed.

The posture calculating section 111 computes the position coordinates of a distal end (claw tip) of the bucket 8 in the geographic coordinate system used for construction by the hydraulic excavator 1, on the basis of the angle information on the front implement members 6, 7, and 8 in the machine body coordinate system, the angle information being computed by the posture sensors 20, and the position coordinate information on the boom pin in the geographic coordinate system, the position coordinate information being computed by the position information detecting section 110. In addition, the posture calculating section 111 can calculate posture information for computing an image of the hydraulic excavator 1 as viewed from the side, the image being for use on the display 19.

The construction target surface calculating section 112 calculates the sectional shape of the construction target surface corresponding to the position of the bucket 8, on the basis of the position information on the construction target surface in the geographic coordinate system which is input from the construction target surface setting device 24 and stored in the storage device 25 and the position information on the bucket claw tip in the geographic coordinate system which is calculated by the posture calculating section 111. The sectional shape of the construction target surface which is computed here is used for calculation of the target surface distance, the sectional shape of the construction target surface presented by the display 19, and the like. Incidentally, while the construction target surface is assumed to be defined in the geographic coordinate system in this case, the construction target surface may be defined in a site coordinate system set on the work site.

Figure 6:
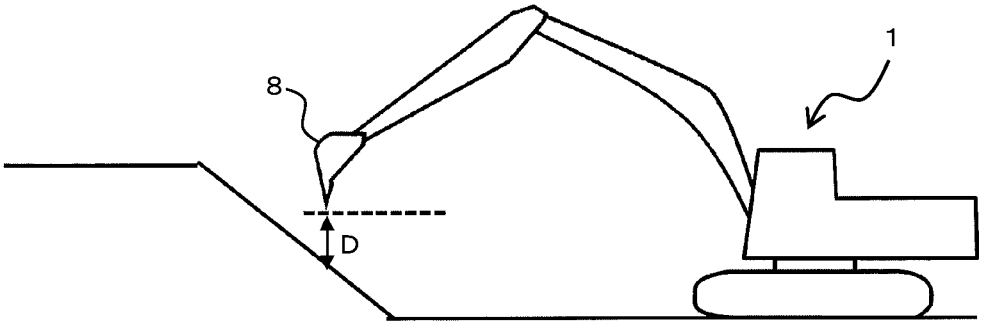
FIG. 6 is a diagram illustrating positional relation between a construction target surface and the hydraulic excavator (front work implement).

The operation state estimating section 113 estimates the operation contents of the hydraulic excavator 1 on the basis of information input from the operation sensor 34 and the operation state information obtaining device 27. For example, the operation state estimating section 113 determines whether the hydraulic excavator 1 is performing excavation, on the basis of machine body position information, posture sensor information, operation sensor information, and construction target surface information described earlier. Whether the hydraulic excavator 1 is actually performing excavation work may not be able to be determined on the basis of only the above-described information, in some cases. Thus, the determination may be made by using information of the pressure sensors attached to the respective actuators 9, 10, and 11. In addition, the operation state estimating section 113 calculates a target surface distance D (see FIG. 6) as a distance between the construction target surface and the front work implement 3, on the basis of the position information on the construction target surface which is stored in the storage device 25, the position information on the machine main body 2 which is calculated by the GNSS receiver 21, and the posture information on the front work implement 3 which is detected by the posture sensors 20. Incidentally, in the present embodiment, the target surface distance D is a distance between the construction target surface and the distal end (claw tip) of the bucket 8, as shown in FIG. 6, and the target surface distance D is negative when the distal end of the bucket 8 is located below the construction target surface.

The abnormal state determining section 114 determines what is abnormal with regard to the operation of the hydraulic excavator 1, on the basis of information about an abnormality of each piece of equipment included in the hydraulic excavator 1, such as the posture sensors 20, the GNSS receiver 21, the construction target surface setting device 24, the camera 22, the radio 29, and the communication device 23. In the computerized construction machine, the operator operates so as to perform excavation along the presented construction target surface. However, if the distal end of the bucket enters below the construction target surface and there is excessive excavation with respect to the construction target surface as a result of actual construction, the operator recognizes the occurrence of an abnormality. At times of those abnormalities, the abnormal state determining section 114 determines whether a failure of equipment itself is the cause or whether satellite reception conditions or radio wave conditions related to communication are poor. Details of processing performed by the abnormal state determining section 114 will next be described.

Figure 5:
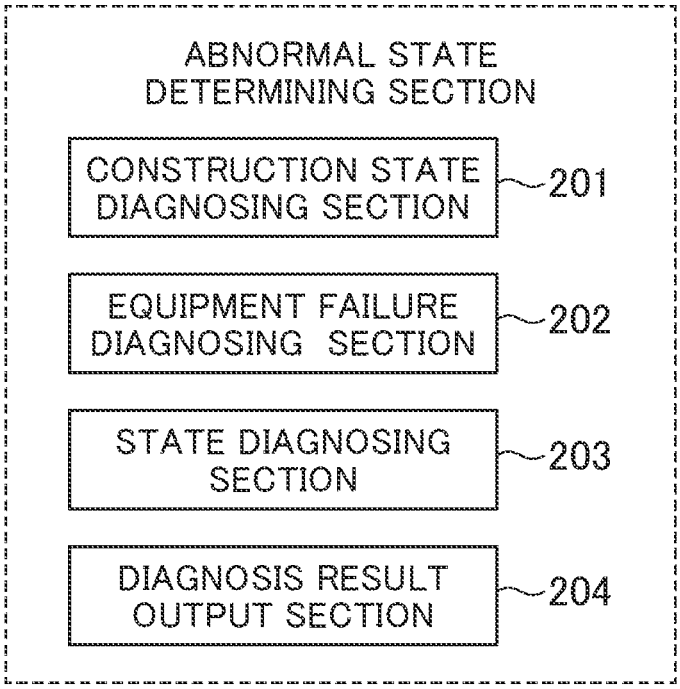
FIG. 5 is a diagram illustrating a functional block diagram of an abnormal state determining section 114 according to the embodiment of the present invention.

In the following, computerized construction in which machine control that controls at least the boom 6 (boom cylinder 9) such that the distal end of the bucket 8 is retained above the construction target surface is performed will be taken as an example. FIG. 5 represents a functional block diagram of the abnormal state determining section 114 according to the present embodiment. As shown in FIG. 5, the abnormal state determining section 114 functions as a construction state diagnosing section 201, an equipment failure diagnosing section 202, and a state diagnosing section 203.

The construction state diagnosing section 201 is a section that determines the presence or absence of an abnormality by diagnosing a state of construction by the hydraulic excavator 1. As shown in FIG. 6, the construction state diagnosing section 201 determines the presence or absence of an abnormality by determining whether or not excessive excavation has occurred with respect to the construction target surface, on the basis of the target surface distance D calculated by the operation state estimating section 113 and a predetermined value d1. When excessive excavation has occurred with respect to the construction target surface, the front work implement 3 (distal end (claw tip) of the bucket 8) is located below the construction target surface. When the target surface distance D reaches less than the predetermined value d1, the construction state diagnosing section 201 in the present embodiment determines that excessive excavation has occurred with respect to the construction target surface (that is, a construction state is degraded) and that an abnormality has occurred. The predetermined value d1 is a negative value, and a value smaller than $-\alpha$ [mm] as a lower limit value of a required accuracy range ($-\alpha$ [mm]<D<$\alpha$ [mm]), for example, can be used as the predetermined value d1.

When the construction state diagnosing section 201 determines that an abnormality has occurred, the construction state diagnosing section 201 outputs a snapshot data recording command to the information recording section 115. The snapshot data recording command is a command for making the information recording section 115 record snapshot data (to be described later) in the storage device 25. The snapshot data recording command may include a command that makes the information recording section 115 transmit the snapshot data to the external management server 102. In addition, the snapshot data recording command can also be output to the information recording section 115 within the controller 100 of another hydraulic excavator (another machine) located around the own machine (hydraulic excavator 1).

The information recording section 115 shown in FIG. 4 is a section that, when the snapshot data recording command is input to the information recording section 115, records snapshot data in a predetermined period with the time of the input as a reference in the storage device 25. In the present embodiment, when the construction state diagnosing section 201 determines that an abnormality has occurred (that is, when the target surface distance D<d1 holds), the information recording section 115 records (stores), in the storage device 25, the snapshot data of information about the operation sensor 34, the pressure sensors 27, the posture sensors 20, the GNSS receiver 21, and the radio (first communication device) 29 in the predetermined period with the time of the determination as a reference. The recording range of the snapshot data may be started before the predetermined time with the time of the occurrence of the abnormality as a reference. In this case, it suffices, for example, to use such specifications that data related to each piece of equipment (data that will become snapshot data in the future) is temporarily stored in the storage device 25 irrespective of whether or not an abnormality has occurred, and the data is erased with the passage of time.

A snapshot data recording command may be input from the controller 100 of another hydraulic excavator 1 in some cases. For example, when it is determined that an abnormality has occurred in a certain hydraulic excavator 1, a snapshot data recording command is output from the construction state diagnosing section 201 (controller 100) of the certain hydraulic excavator 1 also to the information recording section 115 (controller 100) of another hydraulic excavator 1 located within a predetermined distance with the certain hydraulic excavator 1 set as a reference. Consequently, the other hydraulic excavator also records snapshot data within the predetermined period with the time of occurrence of the abnormality in the certain hydraulic excavator 1 as a reference, and the snapshot data of each hydraulic excavator 1 is transmitted to and stored in the external management server 102. It is therefore possible to refer also to the snapshot data of the other hydraulic excavator 1 located in the surroundings of the certain hydraulic excavator 1 detecting the abnormality. Thus, whether an abnormality due to a surrounding environment has occurred may be able to be determined in some cases. For example, when there is radio interference or the like in the surroundings and satellite reception conditions are poor, a similar abnormality is considered to have occurred also in a plurality of hydraulic excavators present in the surroundings.

The snapshot data may include an image photographed by the camera 22 in the predetermined period with the time that the target surface distance D reaches less than the predetermined value d1 as a reference. This image may be a still image or may be a moving image. It is possible to check the conditions of the surrounding environment at the time of the occurrence of the abnormality, by referring to this image.

The snapshot data includes the position of the machine main body 2 (upper swing structure 4), the posture of the front work implement 3, an amount of operation of the control lever 17 by the operator, pressure sensor values of the respective actuators 8, 9, and 10, a kind of positioning solution by the GNSS receiver 21 (a Fix solution, a Float solution, or a single positioning solution), the number of positioning satellites from which the GNSS receiver 21 can receive satellite signals, a positioning mode of the GNSS receiver 21 (for example, an accurate mode or an approximate mode), conditions of reception of the correction signal by the radio (first communication device) 29 (communication log data), conditions of transmission and reception of data by the communication device (second communication device) 23 (communication log data), a surrounding image photographed by the camera 22, satellite positioning data (for example, in an NMEA format) output from the GNSS receiver 21, a connection setting of the communication device 2, the time at which the target surface distance D reaches less than the predetermined value d1, and the like. The information recording section 115 records the snapshot data in the storage device 25. In addition, when the information recording section 115 stores the snapshot data in the storage device 25 at the time of input of the snapshot data recording command, the information recording section 115 may transmit the snapshot data to the external management server 102 via the communication device 23.

When the construction state diagnosing section 201 determines that an abnormality has occurred (that is, D<d1), it is necessary to determine whether the cause of the abnormality is an equipment failure (that is, an abnormality originating from hardware) or whether the abnormality results from another cause. The equipment failure diagnosing section 202 diagnoses the presence or absence of a failure in equipment included in the hydraulic excavator 1 (for example, at least one piece of equipment among the operation sensor 34, the pressure sensors 27, the posture sensors 20, the GNSS receiver 21, and the radio 29) on the basis of the snapshot data recorded in the storage device 25 by the information recording section 115. That is, here, the presence or absence of a failure in equipment necessary for computerized construction is grasped, the equipment including the posture sensors 20 of the boom 6, the arm 7, the bucket 8, and the like, the operation sensor 34, the GNSS receiver 21, the pressure sensors (operation state information obtaining device) 27 of the respective actuators 9, 10, and 11, the communication device 23, the radio 29, and the like in addition to standard equipment such as the engine 31 and the hydraulic pump 32 mounted in the hydraulic excavator 1. When there is an abnormality in such equipment, the equipment failure diagnosing section 202 outputs information about the faulty equipment and an equipment failure flag.

The state diagnosing section 203 is a section that checks the presence or absence of an abnormality related to communication and GNSS positioning used in computerized construction, on the basis of the snapshot data, when the equipment failure diagnosing section 202 does not find any failure in the mounted equipment. That is, on the basis of the snapshot data, the state diagnosing section 203 performs diagnosis of an abnormality cause related to a state of communication of the radio 29 with a base station and diagnosis of an abnormality cause related to positioning in the GNSS receiver 21. For example, as for the former abnormality cause, correction information necessary in RTK-GNSS (information received by the radio 29) may not be input due to a communication abnormality. In addition, as for the latter abnormality cause, a state of arrangement of positioning satellites may be unbalanced (a DOP (Dilution Of Precision) value may relatively be large). The state diagnosing section 203 outputs an abnormality cause diagnosis result.

A diagnosis result output section 204 displays the diagnosis results of the equipment failure diagnosing section 202 and the state diagnosing section 203, on the display (monitor) 19.

The external management server 102 stores the construction target surface data, soil information, terrain profile information including the periphery of the construction site, a communicable area, and the like, and the external management server 102 can also grasp communication conditions. In addition, it becomes easy to grasp abnormal time data related to the environment such as satellites or communication by adopting a configuration in which, when an abnormality occurs in a certain hydraulic excavator 1, not only the snapshot data of the hydraulic excavator but also the snapshot data of the hydraulic excavators 1 in the surroundings thereof is uploaded to the server. In particular, in performing computerized construction, during work using such machine control that the operation of a part of the machine is automated in the computerized construction, an event may occur in which deep excavation is excessively performed with respect to the construction target surface or in which the bucket cannot approach the construction target surface. In such a case, conventionally, a serviceperson needs to go to the site and determine whether a machine abnormality has occurred or whether there is an effect of surrounding conditions, for example, by observing the actual behavior of the machine and checking the states of various kinds of sensors and the like. In the present embodiment, on the other hand, the work contents and the state of each piece of mounted equipment can be checked after data at the time of the abnormality is transmitted to the external management server 102. Thus, support can be provided efficiently.

Abnormality diagnosis processing of the controller 100 configured as described above will next be described with reference to FIGS. 7 to 10.

Figure 7:
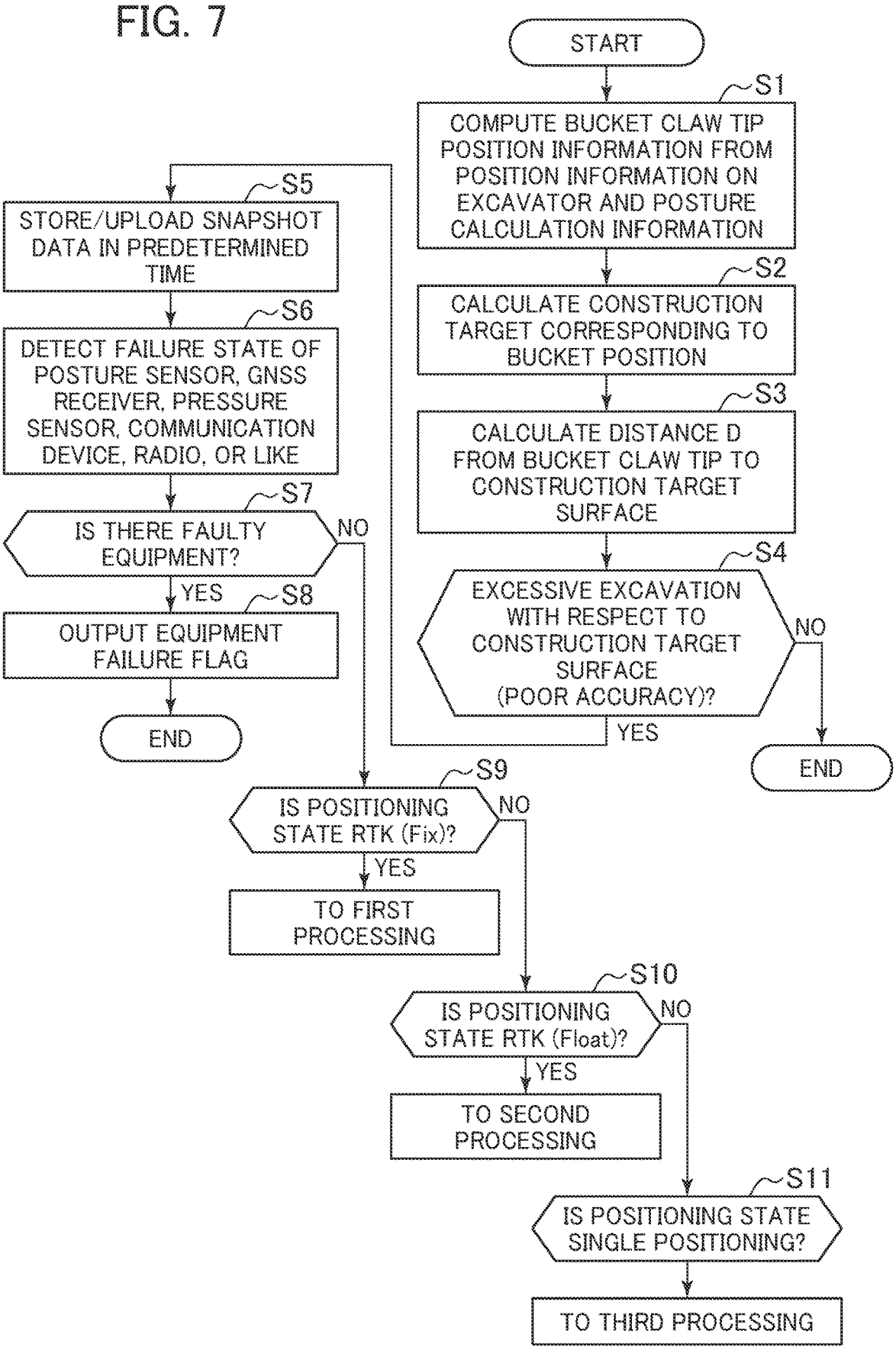
FIG. 7 is a diagram illustrating a flowchart of abnormality diagnosis processing of the controller 100 according to the embodiment of the present invention.

FIG. 7 is a flowchart of the abnormality diagnosis processing of the controller 100.

The controller 100 performs a flow shown in FIG. 7 in predetermined control cycles. When a control cycle arrives, the controller 100 (position information detecting section 110) starts the processing and calculates a coordinate transformation parameter for transforming a point (for example, an origin (middle point in the axial direction of the boom pin)) in the machine body coordinate system into a coordinate value in the geographic coordinate system, by using the position information on the hydraulic excavator 1 (upper swing structure 4) in the geographic coordinate system which is calculated by the GNSS receiver 21, and the detected values of the inclination angle sensors 26*a* and 26*b*. Next, the controller 100 (posture calculating section 111) calculates the position information on the claw tip (distal end) of the bucket 8 in the geographic coordinate system on the basis of the calculated coordinate transformation parameter and the detected values of the posture sensors 20 (posture information on the front work implement 3) (step S1).

In step S2, the controller 100 (construction target surface calculating section 112) calculates the sectional shape of the construction target surface corresponding to the position of the bucket 8, on the basis of the position information on the construction target surface in the geographic coordinate system which is input from the construction target surface setting device 24 and stored in the storage device 25 and the position information on the bucket claw tip in the geographic coordinate system which is calculated by the posture calculating section 111.

In step S3, the controller 100 (operation state estimating section 113) calculates the target surface distance D as a distance from the bucket claw tip to the construction target surface, on the basis of the position information on the bucket claw tip which position information is calculated in step S1 and the sectional shape of the construction target surface which sectional shape is calculated in step S2.

In step S4, the controller 100 (construction state diagnosing section 201) determines whether or not excessive excavation has occurred with respect to the construction target surface by determining whether or not the target surface distance D calculated in step S3 is less than the predetermined value d1. That is, whether or not an accuracy required for machine control is not achieved and thus an abnormality has occurred is determined. Here, when the target surface distance D is equal to or more than d1, it is determined that no abnormality has occurred, and the processing proceeds to step S20. The processing is then ended. When the target surface distance D is less than d1, on the other hand, it is determined that an abnormality has occurred, and an abnormality occurrence time is stored in the storage device 25. The processing then proceeds to step S5.

In step S5, the construction state diagnosing section 201 (controller 100) outputs a snapshot data recording command to the information recording section 115. With the input of the snapshot data recording command as a trigger, the information recording section 115 records snapshot data in the storage device 25 and uploads the same snapshot data to the external management server 102.

In step S6, the controller 100 (equipment failure diagnosing section 202) diagnoses the presence or absence of a failure in the equipment necessary for computerized construction (machine control) (the posture sensors 20, the operation sensor 34, the GNSS receiver 21, the pressure sensors (operation state information obtaining device) 27 of the respective actuators 9, 10, and 11, the communication device 23, the radio 29, and the like), on the basis of the snapshot data stored in the storage device 25 in step S5.

In step S7, the controller 100 (equipment failure diagnosing section 202) determines whether or not there is a failure in the equipment necessary for computerized construction in step S6. When there is faulty equipment, the controller 100 (equipment failure diagnosing section 202) proceeds to step S8 and outputs an equipment failure flag. The name of the faulty equipment is thereby displayed on the display 19. When there is no faulty equipment, on the other hand, the processing is advanced to step S9.

In step S9, the controller 100 (state diagnosing section 203) determines whether or not the positioning solution (positioning state) of the GNSS receiver 21 in the snapshot data stored in step S5 is the Fix solution. When the positioning solution is the Fix solution, the processing moves to a flowchart of first processing shown in FIG. 8. When the positioning solution is not the Fix solution, on the other hand, the processing proceeds to step S10.

In step S10, the controller 100 (state diagnosing section 203) determines whether or not the positioning solution (positioning state) of the GNSS receiver 21 in the snapshot data stored in step S5 is the Float solution. When the positioning solution is the Float solution, the processing moves to a flowchart of second processing shown in FIG. 9. When the positioning solution is not the Float solution, that is, when the positioning solution is the single positioning solution, on the other hand, the processing proceeds to step S11.

In step S11, the positioning solution (positioning state) of the GNSS receiver 21 in the snapshot data stored in step S5 is the single positioning solution. Therefore, the controller 100 (state diagnosing section 203) proceeds to a flowchart of third processing shown in FIG. 10.

Figure 8:
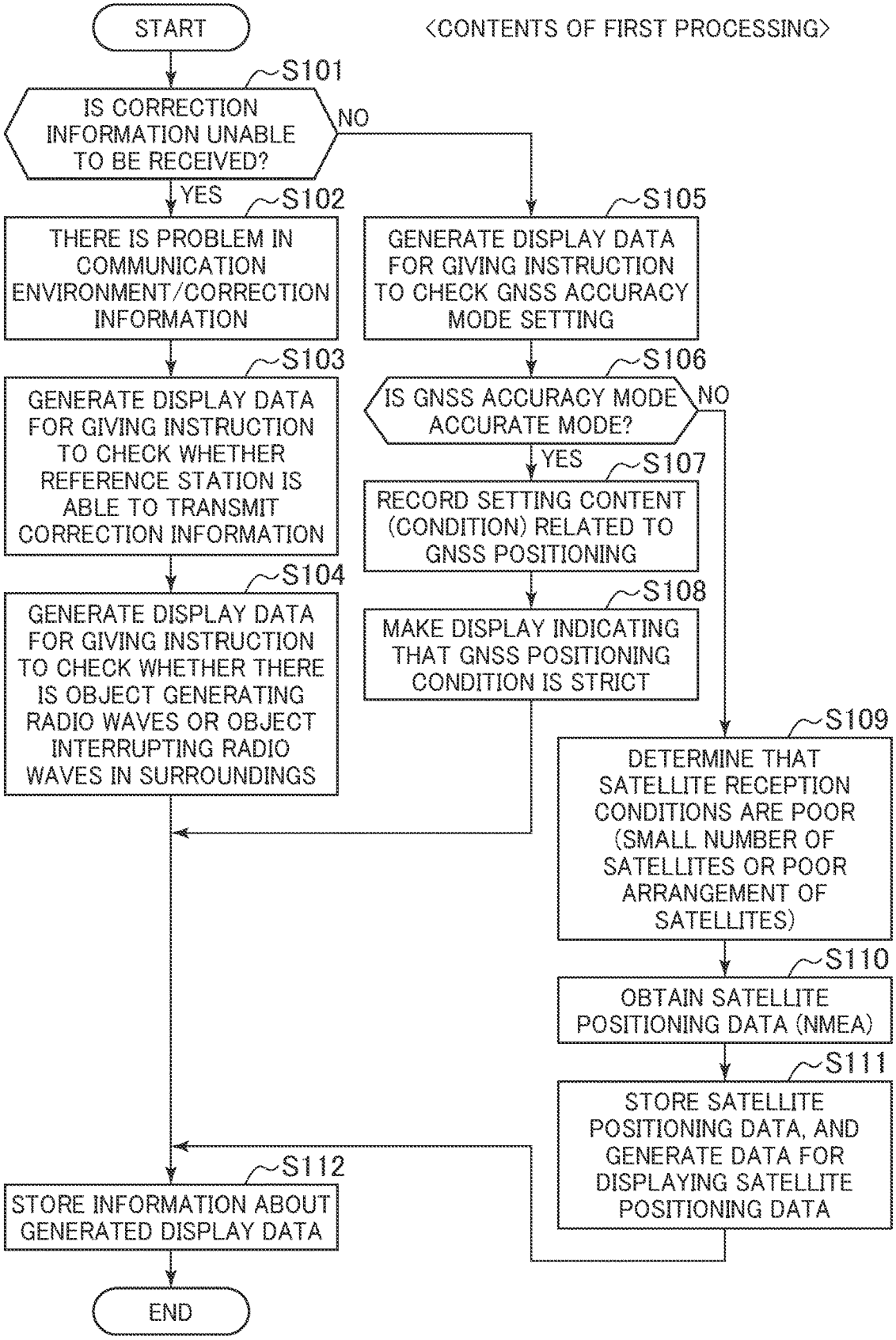
FIG. 8 is a diagram illustrating a flowchart of first processing in FIG. 7.

FIG. 8 is a diagram showing a flowchart of the first processing in FIG. 7. When starting the processing, the controller 100 (state diagnosing section 203) first refers to the snapshot data stored in step S5 and determines whether or not correction information is unable to be received from the reference station via the radio 29 (step S101). Here, when the correction information is unable to be received, the processing is advanced to step S102. When the correction information is able to be received, on the other hand, the processing is advanced to step S105.

In step S102, the controller 100 (state diagnosing section 203) determines that there is a problem in at least either the communication environment of the radio 29 or the correction signal transmitted from the reference station. The controller 100 then moves to next processing (step S103).

In step S103, the controller 100 (diagnosis result output section 204) generates display data (for example, a message or an icon) for giving an instruction to check whether the reference station is able to transmit the correction information, and outputs the display data to the display 19. As a result, the display data is displayed on the display 19.

In the following step S104, the controller 100 (diagnosis result output section 204) also generates display data (for example, a message or an icon) for giving an instruction to check whether or not there is an object generating radio waves or an object interrupting radio waves in the surroundings, and outputs the display data to the display 19. As a result, the display data is displayed on the display 19. When the display on the display 19 is completed, the controller 100 stores information about the display data generated in steps S103 and S104 (for example, the contents of the displayed abnormality causes and measures, data taken into consideration when the display data is generated, a display time, and the like) in the storage device 25 (step S112), ends the processing, and stands by until a next control cycle.

In step S105, on the other hand, the controller 100 (diagnosis result output section 204) generates display data (for example, a message) for instructing the operator to perform input as to whether a GNSS accuracy mode set in the GNSS receiver 21 is either an accurate mode or an approximate mode, and outputs the display data to the display 19. Incidentally, the GNSS accuracy mode in the present embodiment is classified according to the magnitude of variations (errors) of a positioning result with which the GNSS receiver 21 ends positioning computation, and in the accurate mode, variations with which the positioning computation is ended are set to a value relatively smaller than that of the approximate mode (value of high accuracy positioning).

In step S106, the controller 100 (state diagnosing section 203) determines whether or not the GNSS accuracy mode input after display in step S105 is the accurate mode. When the accurate mode is set, the processing proceeds to step S107. Otherwise (when the approximate mode is set), the processing proceeds to step S109.

In step S107, the controller 100 (state diagnosing section 203) stores, in the storage device 25, the GNSS accuracy mode at the time (that is, the accurate mode) and a positioning accuracy determination condition set in the GNSS accuracy mode (for example, when positioning result variations (errors) within 30 mm are tolerated in the accurate mode, a numerical value representing the tolerable range). The processing then proceeds to step S108.

In step S108, the controller 100 (diagnosis result output section 204) generates display data (for example, a message) for making a notification that the strict positioning condition of the set GNSS accuracy mode is the cause of occurrence of the abnormality, and outputs the display data to the display 19. The controller 100 then ends the processing. Receiving the input of the display data, the display 19 performs display to indicate that the setting of the GNSS accuracy mode to the accurate mode is the cause of the abnormality. Then, the controller 100 stores information about the display data generated in steps S105 and S108 in the storage device 25 (step S112), and ends the processing.

When the processing proceeds to step S109 (when the GNSS accuracy mode is the approximate mode), on the other hand, the controller 100 (state diagnosing section 203) diagnoses, as the cause of the abnormality, poor satellite signal reception conditions in the GNSS antennas 28, specifically, a small number of satellites from which satellite signals can be received, a poor arrangement of satellites from which satellite signals can be received, or the like.

In step S110, the controller (diagnosis result output section 204) obtains satellite positioning data (for example, in the NMEA format) output from the GNSS receiver 21. The controller stores the satellite positioning data in the storage device 25, generates display data for displaying the satellite positioning data on the display 19, and outputs the display data to the display 19 (step S111). After the display 19 that has received the input of the display data displays the satellite positioning data, the controller 100 stores information about the display data generated in steps S105 and S111, in the storage device 25 (step S112). The processing is then ended.

Figure 9:
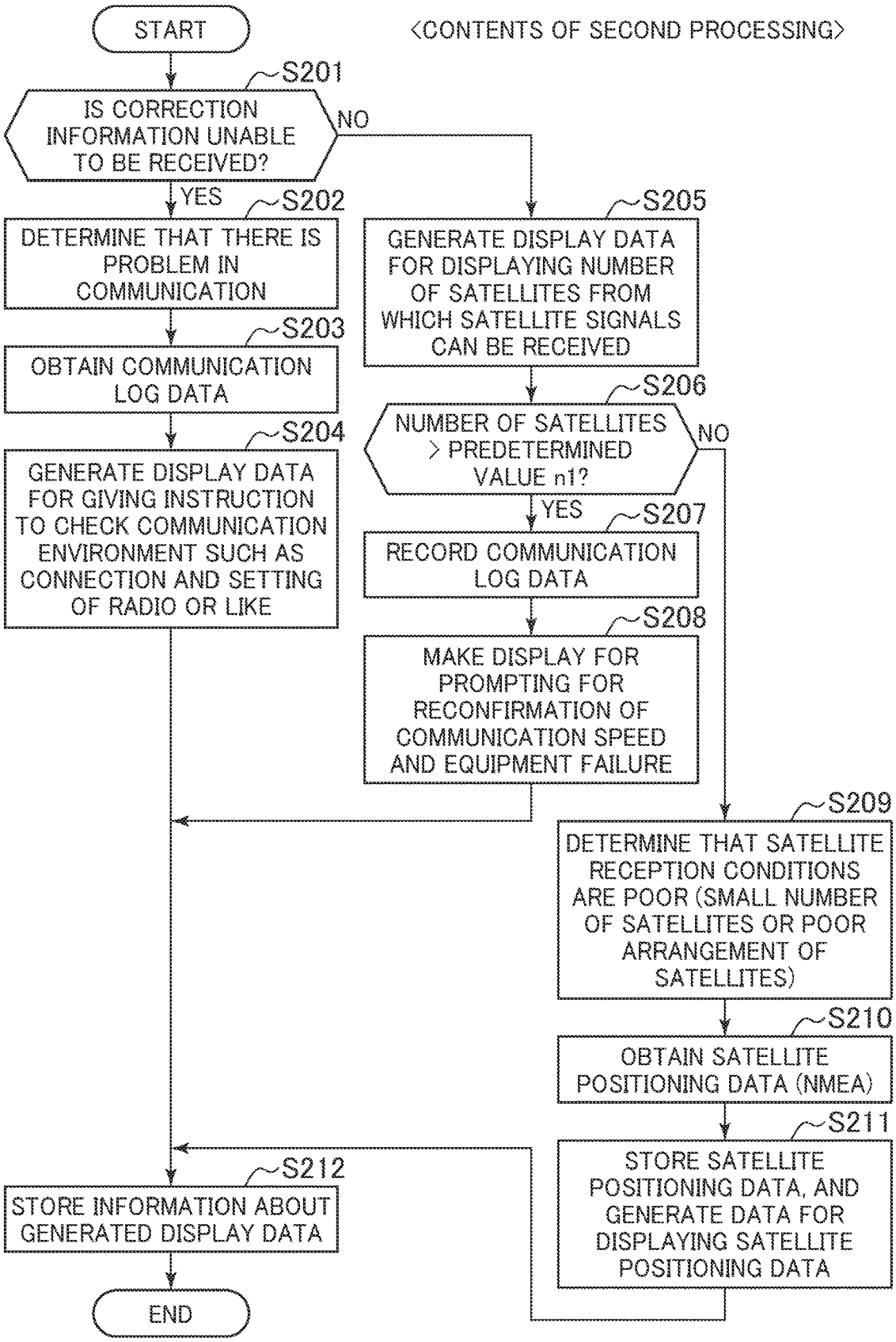
FIG. 9 is a diagram illustrating a flowchart of second processing in FIG. 7.

FIG. 9 is a diagram showing a flowchart of the second processing in FIG. 7. When starting the processing, the controller 100 (state diagnosing section 203) first refers to the snapshot data stored in step S5 and determines whether or not the correction information is unable to be received from the reference station via the radio 29 (step S201). Here, when it is found that the correction information is unable to be received, the processing is advanced to step S202. When it is found that the correction information is able to be received, on the other hand, the processing is advanced to step S205.

In step S202, the controller 100 (state diagnosing section 203) determines that there is a problem in the communication environment of the radio 29. The controller 100 then moves to next processing (step S203).

In step S203, the controller 100 (state diagnosing section 203) obtains the communication log data of the radio 29 and stores the communication log data in the storage device 25.

In step S204, the controller 100 (diagnosis result output section 204) generates display data (for example, a message) for prompting the operator to check the communication environment of the radio 29 such as a connection and a setting of the radio 29, and outputs the display data to the display 19. Receiving the input of this display data, the display 19 displays the display data, and the controller 100 stores information about the display data generated in step S204, in the storage device 25 (step S212). The processing is then ended.

When the processing proceeds to step S205 (when the correction information is able to be received by the radio 29), on the other hand, the controller 100 (diagnosis result output section 204) generates display data for having the operator (or the user) check the number of satellites from which the GNSS receiver 21 can receive satellite signals (for example, a message in which the number of satellites can be grasped, such as a "total number of satellites: X ([breakdown] GPS: x1, GLONASS: x2, . . . )"), and outputs the display data to the display 19.

In step S206, the controller 100 (state diagnosing section 203) determines whether or not the number of satellites which is displayed in step S205 exceeds a predetermined value n1 (for example, 10). When the displayed number of satellites exceeds the predetermined value n1, the processing proceeds to step S207. Otherwise (when the number of satellites is equal to or less than 10), the processing proceeds to step S209.

In step S207, the controller 100 (state diagnosing section 203) obtains the communication log data of the radio 29 and stores the communication log data in the storage device 25.

In step S208, the controller 100 (diagnosis result output section 204) generates display data (for example, a message) for prompting the operator to reconfirm the communication speed of the radio 29 and an equipment failure and outputs the display data to the display 19. Receiving the input of the display data, the display 19 displays the display data, and the controller 100 stores information about the display data generated in steps S205 and S208, in the storage device 25 (step S212). The processing is then ended.

When the processing proceeds to step S209 (when the number of satellites is equal to or less than the predetermined value n1), on the other hand, the controller 100 (state diagnosing section 203) diagnoses, as the cause of the abnormality, poor satellite signal reception conditions in the GNSS antennas 28, specifically, a small number of satellites from which satellite signals can be received, a poor arrangement of satellites from which satellite signals can be received, or the like.

In step S210, the controller (diagnosis result output section 204) obtains the satellite positioning data (for example, in the NMEA format) output from the GNSS receiver 21. The controller stores the satellite positioning data in the storage device 25, generates display data for displaying the satellite positioning data on the display 19, and outputs the display data to the display 19 (step S211). Receiving the input of the display data, the display 19 displays the satellite positioning data, and the controller 100 stores information about the display data generated in steps S205 and S211, in the storage device 25 (step S212). The processing is then ended.

Figure 10:
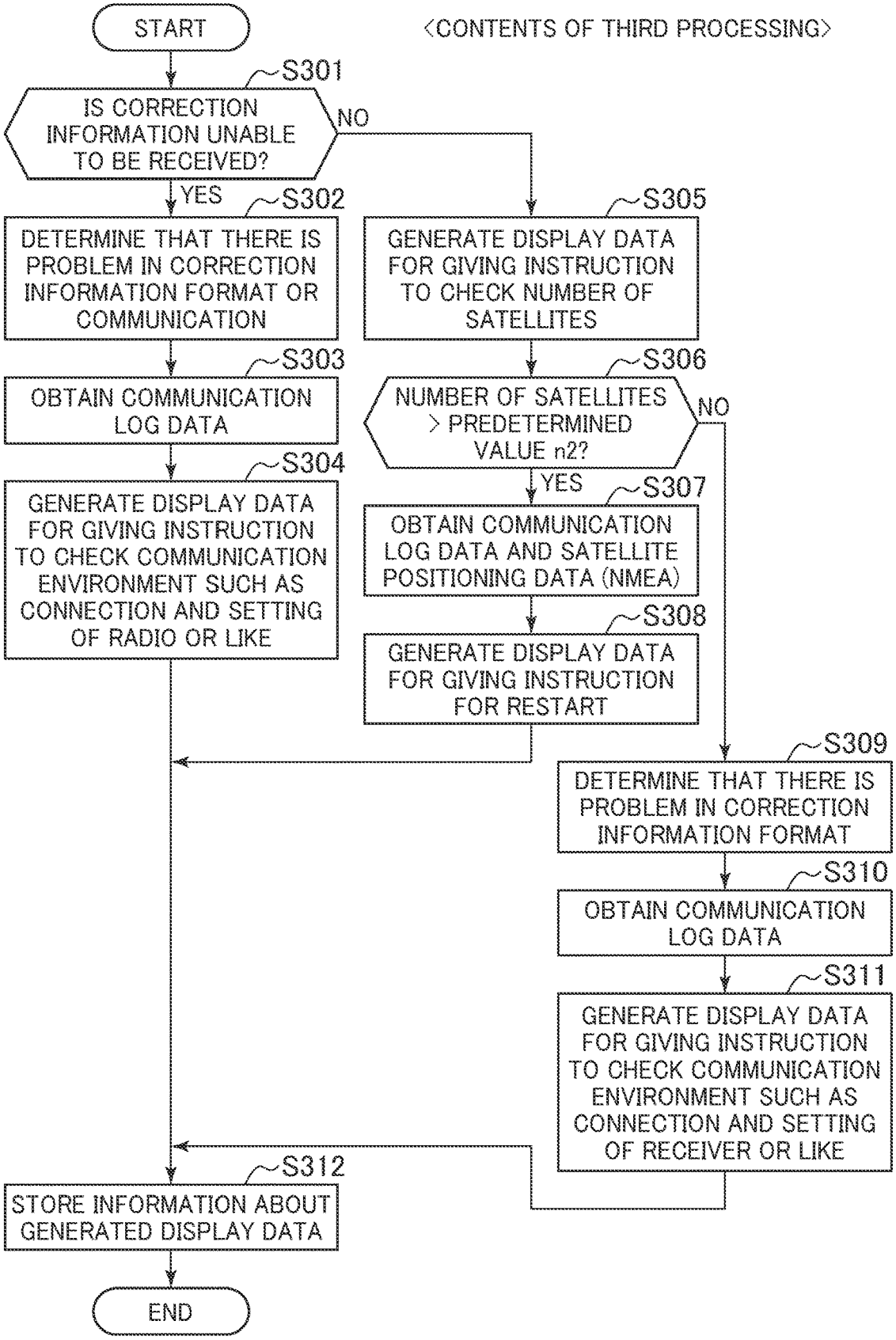
FIG. 10 is a diagram illustrating a flowchart of third processing in FIG. 7.

FIG. 10 is a diagram showing a flowchart of the third processing in FIG. 7. When starting the processing, the controller 100 (state diagnosing section 203) first refers to the snapshot data stored in step S5 and determines whether or not the correction information is unable to be received from the reference station via the radio 29 (step S301). Here, when it is found that the correction information is unable to be received, the processing is advanced to step S302. When it is found that the correction information is able to be received, on the other hand, the processing is advanced to step S305.

In step S302, the controller 100 (state diagnosing section 203) determines that there is a problem in the correction information format of the radio 29 or the communication environment of the radio 29. The controller 100 then moves to next processing (step S303).

In step S303, the controller 100 (state diagnosing section 203) obtains the communication log data of the radio 29 and stores the communication log data in the storage device 25.

In step S304, the controller 100 (diagnosis result output section 204) generates display data (for example, a message) for prompting the operator to check the communication environment of the radio 29 such as a connection and a setting of the radio 29, and outputs the display data to the display 19. Receiving the input of the display data, the display 19 displays the display data, and the controller 100 stores information about the display data generated in step S304, in the storage device 25 (step S312). The processing is then ended.

When the processing proceeds to step S305 (when the correction information is able to be received by the radio 29), on the other hand, the controller 100 (diagnosis result output section 204) generates display data (for example, a message) for instructing the operator to input the number of satellites from which the GNSS receiver 21 can receive satellite signals, and outputs the display data to the display 19. Then, the controller 100 stores information about the display data generated in steps S305 and S308, in the storage device 25 (step S312). The processing is then ended.

In step S306, the controller 100 (state diagnosing section 203) determines whether or not the number of satellites which is input after display in step S305 exceeds a predetermined value n2 (for example, zero). When the input number of satellites exceeds the predetermined value n2, the processing proceeds to step S307. Otherwise (when the number of satellites is zero), the processing proceeds to step S309.

In step S307, the controller 100 (state diagnosing section 203) obtains the communication log data of the radio 29 and stores the communication log data in the storage device 25, and obtains the satellite positioning data (for example, in the NMEA format) output from the GNSS receiver 21 and stores the satellite positioning data in the storage device 25.

In step S308, the controller 100 (diagnosis result output section 204) generates display data (for example, a message) for prompting the operator to restart the radio 29 and the GNSS receiver 21, and outputs the display data to the display 19. Receiving the input of this display data, the display 19 displays the display data. The processing is then ended.

On the other hand, in step S309, the controller 100 (state diagnosing section 203) determines that there is a problem in the correction information format of the radio 29. The controller then moves to next processing (step S310).

In step S310, the controller 100 (state diagnosing section 203) obtains the communication log data of the radio 29 and stores the communication log data in the storage device 25.

In step S311, the controller 100 (diagnosis result output section 204) generates display data (for example, a message) for prompting the operator to check the communication environment of the radio 29 such as a connection and a setting of the radio 29, and outputs the display data to the display 19. Receiving the input of this display data, the display 19 displays the display data, and the controller 100 stores information about the display data generated in steps S305 and S311, in the storage device 25 (step S312). The processing is then ended.

<Actions and Effects>

In the management system configured as described above, the controller 100 included in the hydraulic excavator 1 capable of computerized construction such as what is called machine control determines that an abnormality has occurred when the target surface distance D reaches less than the predetermined value d1, stores, in the storage device 25, the snapshot data of information about the equipment necessary for computerized construction (for example, the operation sensor 34, the pressure sensors 27, the posture sensors 20, the GNSS receiver 21, and the radio 29), and diagnoses a cause of the target surface distance D reaching less than the predetermined value d1, that is, the cause of the abnormality, on the basis of the snapshot data. When the controller 100 is configured as described above, the snapshot data of the information about the equipment necessary for computerized construction can be obtained at a time of the occurrence of the abnormality, and therefore, it becomes easy to identify the abnormality cause.

In the present embodiment, the snapshot data includes an image photographed by the camera 22. It is therefore possible to grasp conditions of the surroundings of the hydraulic excavator 1, the conditions being unable to be grasped from only the operation data (numerical data) of each piece of equipment at the time of the occurrence of the abnormality. For example, it is also possible to detect an obstacle that can cause the abnormality, by interrupting signals to the radio 29 and the GNSS receiver 21.

Further, in the present embodiment, the use of the snapshot data recording command enables the management system to be configured such that the controllers 100 of other hydraulic excavators located in the surroundings of the hydraulic excavator in which the abnormality has occurred also record snapshot data and transmit the display data to the server 102. When the system is thus configured such that not only the snapshot data of the hydraulic excavator in which the abnormality is detected but also the snapshot data of the hydraulic excavators in the surroundings is uploaded to the server 102 in conjunction with the hydraulic excavator, it becomes easy to grasp that an abnormality occurs not due to hardware but the surrounding environment, and it becomes easy to identify an abnormality cause.

In particular, the controller 100 according to the present embodiment first diagnoses the presence or absence of a hardware failure in the equipment necessary for computerized construction. When that kind of failure is not detected, the controller 100 attempts to identify the abnormality cause by performing different processing (three pieces of processing in the present embodiment) according to the positioning solution of the GNSS receiver 21. Specifically, the controller 100 is configured to diagnose an abnormality cause related to the state of communication of the radio (first communication device) 29 with the base station and an abnormality cause related to positioning in the GNSS receiver 21, on the basis of the conditions of reception of the correction information from the base station, the GNSS accuracy mode, and the number of satellites from which satellite signals are received. It is thereby possible to diagnose and identify not only a failure in hardware but also an abnormality cause related to communication conditions of the communication equipment necessary for computerized construction. Thus, a period of time from the occurrence of an abnormality to a return to work can be shortened, so that work efficiency can be improved.

In addition, in the management system according to the present embodiment, a result of diagnosis by the controller 100 can be displayed on the display (monitor) 19 within the cab 12 of the hydraulic excavator 1. Thus, the abnormality cause and a measure effective for resolving the abnormality can promptly be transmitted to the operator. There is an abnormality that is resolved when the operator himself/herself implements the displayed measure. Thus, opportunities to return to normal work without waiting for arrival of a serviceperson or inquiry to the manufacturer are increased, so that work efficiency can be improved. In addition, the information related to the display data is stored in the storage device 25 (steps S112, 212, and 312) and can therefore be used for diagnosis after the occurrence of the abnormality.

<Others>

Incidentally, in the above description, an example has been described in which, when it is determined in step S4 in FIG. 7 that excessive excavation has occurred with respect to the construction target surface, snapshot data is immediately stored/uploaded in step S5. However, the processing flow may be configured such that the storing/uploading of the snapshot data is performed after an end of step S8. Incidentally, for the failure detection of S6 in this case, it suffices to temporarily store various kinds of information included in the snapshot data with a time at which excessive excavation has occurred in step S4 as a reference, and perform the failure detection on the basis of those pieces of information. The determination of steps S9, S10, and S11 may be made from information at a time of making the determination, or may be made from the various kinds of information temporarily stored with the time of occurrence of excessive excavation as a reference, similarly to step S6. The same is true for various kinds of determination processing performed in the first, second, and third processing (FIGS. 8, 9, and 10). In addition, in the processing of storing the information related to the display data (steps S112, 212, and 213) in the first, second, and third processing, information used when the display data is generated may be stored in the storage device 25 together with the storing of the related information. Incidentally, as with the snapshot data, these pieces of information may be transmitted to the external management server 102 together with or in place of the storing of the information in the storage device 25.

In addition, in the above description, description has been made of a case where the controller 100 of the hydraulic excavator 1 diagnoses an abnormality on the basis of the snapshot data. However, a configuration may be adopted in which the snapshot data temporarily recorded in the storage device 25 at the time of detection of the abnormality is uploaded (transmitted) to the external management server 102, the external management server 102 performs the abnormality diagnosis on the basis of the snapshot data, and a result of the diagnosis is transmitted to the corresponding hydraulic excavator 1. In this case, a configuration is considered in which the server 102 incorporates the functions of the equipment failure diagnosing section 202, the state diagnosing section 203, and the diagnosis result output section 204 in the abnormal state determining section 114 in FIG. 5. In addition, both the controller 100 and the server 102 may be made to store the snapshot data, and both the controller 100 and the server 102 may perform the abnormality diagnosis based on the snapshot data. Further, it is possible to select a configuration in which, when an abnormality has occurred in a certain hydraulic excavator 1, only the server 102 performs the abnormality diagnosis only when the snapshot data of the other hydraulic excavators located in the surroundings of the certain hydraulic excavator 1 is recorded and transmitted to the server 102.

In the above description, it is determined that an abnormality has occurred when the target surface distance D is less than the predetermined value d1, and the snapshot data is then recorded. However, a configuration may be adopted in which the snapshot data is recorded when another condition that makes it possible to identify an abnormality as having occurred in the computerized construction machine is satisfied.

In addition, in place of calculating the target surface distance D, the controller 100 may calculate the magnitude (absolute value) of a difference in position in a height direction between the construction target surface and the front work implement 3, on the basis of the position of the construction target surface which is stored in the storage device 25, the position of the machine main body 2 which is calculated by the GNSS receiver 21, and the posture of the front work implement 3 which is detected by the posture sensors 20 (20*a*, 20*b*, and 20*c*). Whether or not an abnormality has occurred may be determined on the basis of whether or not the magnitude of the position difference exceeds a predetermined value. At this time, it is determined that an abnormality has occurred when the magnitude of the position difference exceeds the predetermined value. Useable as the predetermined value is, for example, $|\pm\alpha|$ which is an absolute value of an upper limit value or a lower limit value of the required accuracy range mentioned in the above description. When the magnitude (absolute value) of the position difference is thus calculated and whether or not an abnormality has occurred is determined, it can be determined that an abnormality has occurred not only when excessive excavation occurs with respect to the construction target surface as described above (when the bucket 8 is located on the lower side of the construction target surface) but also when excavation is insufficient with respect to the construction target surface (when the bucket 8 is located on the upper side of the construction target surface). Incidentally, usable as the "position difference in the height direction" between the construction target surface and the front work implement 3 is a position difference in a vertical direction (gravitational direction) or a position difference in a direction normal to the construction target surface.

In the above description, the target surface distance D is the distance between the construction target surface and the distal end (claw tip) of the bucket 8, as shown in FIG. 6. However, the target surface distance D may be a distance between a control point set to the front work device 3 as desired (point other than the bucket claw tip) and the construction target surface. The same can be said to be true for the calculation of the magnitude (absolute value) of the position difference in the height direction between the construction target surface and the front work implement 3 as mentioned above.

It is to be noted that the present invention is not limited to the foregoing embodiments and includes various modifications within a scope not departing from the spirit of the present invention. For example, the present invention is not limited to including all of the configurations described in the foregoing embodiments and includes configurations obtained by omitting a part of the configurations. In addition, a part of a configuration according to a certain embodiment can be added to or replaced with a configuration according to another embodiment.

In addition, a part or the whole of each configuration of the controller 100 described above and functions, execution processing, and the like of each such configuration may be implemented by hardware (for example, by designing logic for performing each function by an integrated circuit). In addition, the configurations of the controller described above may be a program (software) that implements each function of the configurations of the controller by being read and executed by a calculation processing device (for example, a CPU). Information related to the program can be stored in, for example, a semiconductor memory (a flash memory, an SSD, or the like), a magnetic storage device (a hard disk drive or the like), and a recording medium (a magnetic disk, an optical disk, or the like), and the like.

In addition, in the description of each of the foregoing embodiments, control lines and information lines construed as necessary for the description of the embodiments are illustrated. However, not all of control lines and information lines of a product are necessarily illustrated. Almost all configurations may be considered to be actually interconnected.

DESCRIPTION OF REFERENCE CHARACTERS

1: Hydraulic excavator
2: Machine main body
3: Front work implement (work implement)
4: Upper swing structure
5: Lower track structure
6: Boom
7: Arm
8: Bucket (attachment)
9: Boom cylinder
10: Arm cylinder
11: Bucket cylinder
12: Cab
13: Swing hydraulic motor
15: Travelling motor
16: Swing wheel
17: Control lever (operation device)
19: Display (monitor)
20: Posture sensor
21: GNSS receiver
22: Camera (surrounding information sensor)
23: Communication device (second communication device)
24: Construction target surface setting device
25: Storage device
26: Inclination angle sensor
27: Pressure sensor (operation state information obtaining device)
28: GNSS antenna
29: Radio (first communication device)
31: Engine
32: Hydraulic pump
33: Control valve
34: Operation sensor
100: Controller
101: Management system
102: External management server
103: Support center
110: Position information detecting section
111: Posture calculating section
112: Construction target surface calculating section
113: Operation state estimating section
114: Abnormal state determining section
115: Information recording section
201: Construction state diagnosing section
202: Equipment failure diagnosing section
203: State diagnosing section
204: Diagnosis result output section

The invention claimed is:

1. A work machine comprising:

a work implement attached to a machine main body, the work implement including a bucket;

an operation sensor that detects an operation of the work implement by an operator;

a hydraulic actuator that drives the work implement;

a pressure sensor that detects a pressure on the hydraulic actuator;

a posture sensor that detects a posture of the work implement;

an antenna that is attached to the machine main body and receives satellite signals from a plurality of positioning satellites;

a receiver configured to calculate a position of the machine main body on a basis of the satellite signals received by the antenna;

a first communication device that receives, from a base station, a correction signal used when the receiver calculates the position of the machine main body; and a controller having a storage device storing a position of a construction target surface, the construction target surface set by construction target surface data input from outside, and configured to calculate magnitude of a position difference in a height direction between the construction target surface and the work implement on a basis of the position of the construction target surface stored in the storage device, the position of the machine main body calculated by the receiver, and the posture of the work implement detected by the posture sensor, and the controller being configured to make the work implement perform excavation by machine control that controls the hydraulic actuator such that the distal end of the bucket is retained above the construction target surface, on a basis of the position of the construction target surface stored in the storage device, the position of the machine main body calculated by the receiver, and the posture of the work implement detected by the posture sensor, during performing excavation by the machine control, the controller being configured to record, in the storage device, snapshot data of information about the operation sensor, the pressure sensor, the posture sensor, the receiver, and the first communication device related to the machine control in a predetermined period determined based on a time at which the magnitude of the position difference exceeds a predetermined value when the magnitude of the position difference exceeds the predetermined value, and diagnose a cause of the magnitude of the position difference exceeding the predetermined value, on a basis of the snapshot data.

2. The work machine according to claim 1, wherein the controller is configured to diagnose presence or absence of a failure in at least one piece of equipment among the operation sensor, the pressure sensor, the posture sensor, the receiver, and the first communication device on a basis of the snapshot data recorded in the storage device when the magnitude of the position difference exceeds the predetermined value, and the controller is configured to, when no failure is detected in the at least one piece of equipment, diagnose whether a cause is an abnormality related to a state of communication of the first communication device with the base station and diagnose whether the cause is an abnormality related to positioning by the receiver.

3. The work machine according to claim 1, further comprising:

a second communication device that transmits information stored in the storage device to an external server, wherein the controller is configured to transmit the snapshot data to the server via the second communication device when the magnitude of the position difference exceeds the predetermined value.

4. The work machine according to claim 3, wherein the controller is configured to transmit, via the second communication device to a controller of another work machine located in surroundings of the work machine, a command to transmit snapshot data in the other work machine to the server when the magnitude of the position difference exceeds the predetermined value.

5. The work machine according to claim 1, further comprising:

a camera that photographs surroundings of the machine main body, wherein the snapshot data includes an image photographed by the camera in the predetermined period determined based on the time at which the magnitude of the position difference exceeds the predetermined value.

6. The work machine according to claim 2, further comprising:

a monitor that displays a diagnosis result obtained by the controller.

7. A work machine management system comprising:

a server connected so as to be capable of two-way communication with a work machine, the work machine management system in which the server diagnoses an abnormality caused in the work machine, an operation sensor that detects an operation of a work implement of the work machine by an operator, a pressure sensor that detects a pressure on a hydraulic actuator that drives the work implement of the work machine, a posture sensor that detects a posture of the work implement of the work machine, an antenna that receives satellite signals from a plurality of positioning satellites, a receiver configured to calculate a position of the machine main body of the work machine on a basis of the satellite signals received by the antenna, a first communication device that receives, from a base station, a correction signal used when the receiver calculates the position of the machine main body of the work machine, and a controller having a storage device storing a position of a construction target surface, the construction target surface set by construction target surface data input from outside, and configured to calculate magnitude of a position difference in a height direction between the construction target surface and the work implement of the work machine on a basis of the position of the construction target surface stored in the storage device, the position of the machine main body of the work machine calculated by the receiver, and the posture of the work implement of the work machine detected by the posture sensor, the controller being configured to make the work implement perform excavation by machine control that controls the hydraulic actuator such that the work implement of the work machine is retained above the construction target surface, and to, during a performing excavation by the machine control, record, in the storage device, snapshot data of information about the operation sensor, the pressure sensor, the posture sensor, the receiver, and the first communication device related to the machine control in a predetermined period determined based on a time at which the magnitude of the position difference exceeds a predetermined value when the magnitude of the position difference exceeds the predetermined value, and transmit the snapshot data to the server, and the server diagnosing a cause of the magnitude of the position difference exceeding the predetermined value in the work machine on a basis of the snapshot data transmitted from the controller.

* * * * *